United States Patent [19]

Newsom et al.

[11] Patent Number: 4,750,417

[45] Date of Patent: Jun. 14, 1988

[54] METHOD FOR COMPACTING LOW DENSITY ARTICLES

[75] Inventors: Horace R. Newsom, Midland, Tex.; Michael W. Lockman, Hewitt, Tex.

[73] Assignee: Mosley Machinery Co., Waco, Tex.

[21] Appl. No.: 27,407

[22] Filed: Mar. 18, 1987

Related U.S. Application Data

[62] Division of Ser. No. 843,119, Mar. 24, 1986, Pat. No. 4,669,375.

[51] Int. Cl.[4] ..... B30B 13/00; B30B 15/26; B30B 15/30

[52] U.S. Cl. ..... 100/35; 100/45; 100/215; 198/505; 414/296

[58] Field of Search ..... 100/35, 45, 215, 216, 100/902, 152, 100, 99, 229 A; 198/505; 177/120, 121; 414/296

[56] References Cited

U.S. PATENT DOCUMENTS

| | | | |
|---|---|---|---|
| 769,692 | 9/1904 | Davies | 100/215 |
| 2,381,505 | 8/1945 | Lindholm | 414/296 X |
| 3,636,863 | 1/1972 | Wayden | 100/45 X |
| 3,685,437 | 8/1972 | Panning | 100/45 |
| 4,130,055 | 12/1978 | Langley | 100/100 X |
| 4,333,394 | 6/1982 | Brown | 177/120 X |
| 4,463,669 | 8/1984 | Van Dorn et al. | 100/45 X |
| 4,669,375 | 6/1987 | Newsom et al. | 100/45 |

*Primary Examiner*—Andrew M. Falik

*Attorney, Agent, or Firm*—Brumbaugh, Graves, Donohue & Raymond

[57] ABSTRACT

In a method of compacting low density articles a conveyor supplies articles to be compacted to a hopper positioned alongside the upper end of a compression chamber in which a platen is adapted to be reciprocated. When the presence of a specified charge in the hopper is sensed, the conveyor is disabled, the hopper and hydraulic cylinder with the platen in the retracted position are swung laterally to bring the hopper over the compression chamber to dump the contained articles into the chamber. The hopper and cylinder are then returned to their initial positions, the cylinder is actuated to cause the platen to compress the dumped articles, and the conveyor is again enabled to supply articles to the hopper. If multiple charges are required to produce a compressed biscuit of given weight, a selected weight is represented by presetting the positional relation between an actuator and a sensor successive displacements of a beam balance which measures the weight of a charge in the hopper are caused to change that positional relation until the actuator is in position to actuate the sensor. The steps of the method are controlled automatically by a programmed computer.

5 Claims, 11 Drawing Sheets

FIG. 3B
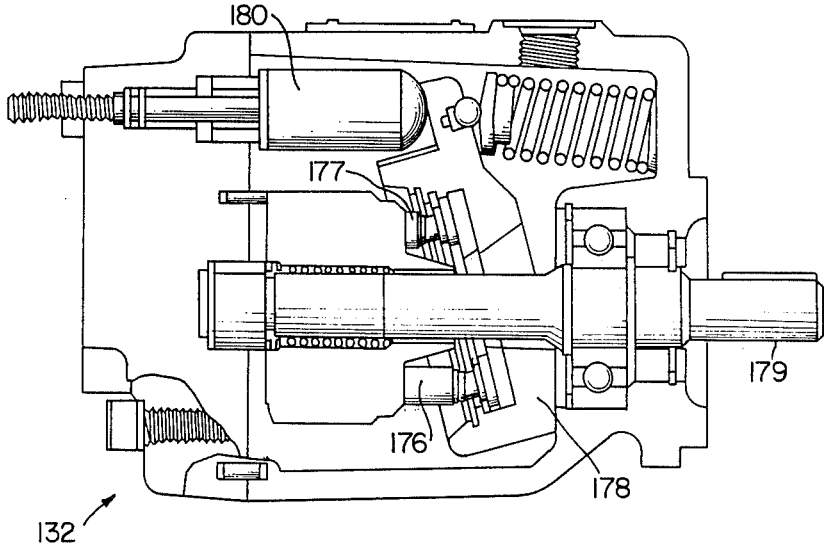
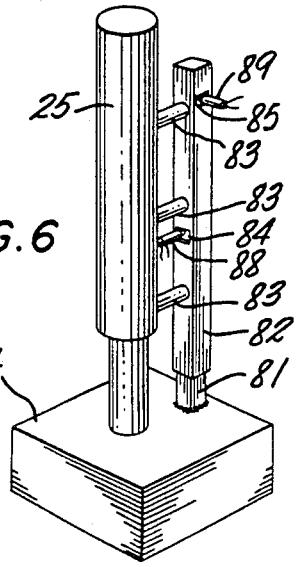
FIG. 6
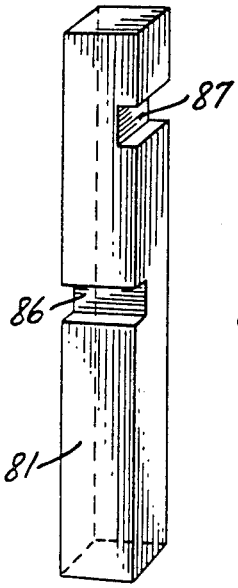
FIG. 7
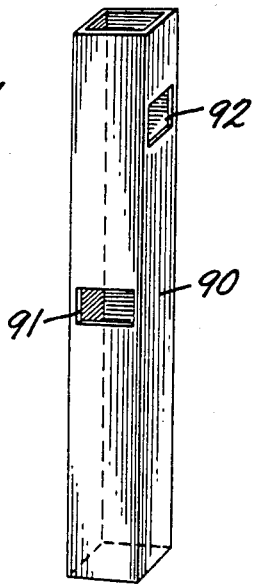
FIG. 8

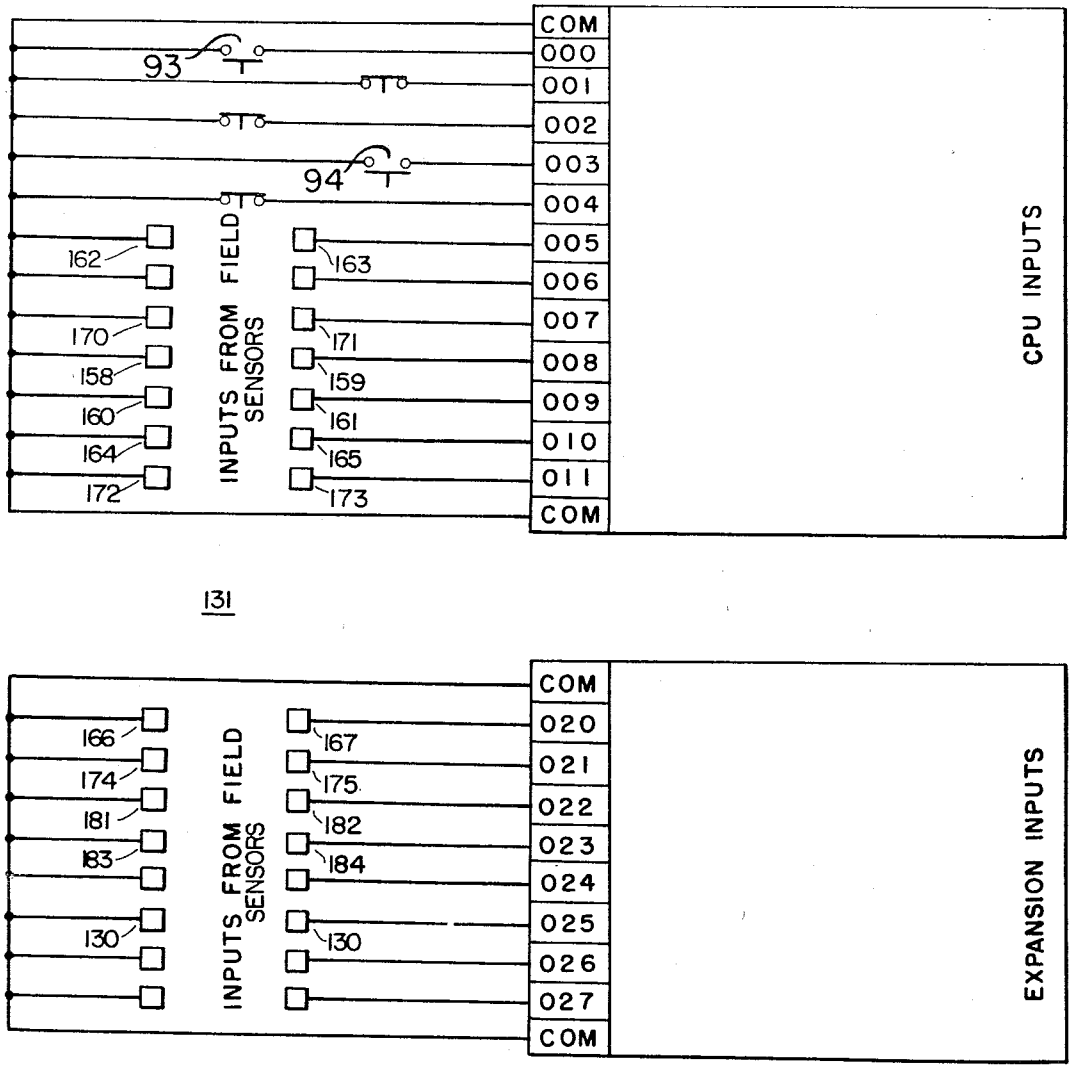

FIG. 12A

AUTO CYCLE START PB
AUTO CYCLE STOP PB
EMERGENCY STOP PB
PUMP START PB
PUMP STOP PB
MAIN CYLINDER RETRACTED
MAIN CYLINDER AT BISQUIT POS.
MAIN CYLINDER EXTENDED
VERTICAL CYLINDER RETRACTED
VERTICAL CYLINDER EXTENDED
SWING CYLINDER RETRACTED
SWING CYLINDER EXTENDED

DOOR CYLINDER RETRACTED
DOOR CYLINDER EXTENDED
TOP PHOTO-CELL
BOTTOM PHOTO-CELL
HOPPER IN FILL POS. LIMIT SWITCH
BATCH ACHIEVED
REGENERATION PRESSURE SWITCH
ALARM
(HYDRAULIC OIL LEVEL LOW,
OIL OVER TEMPERATURE,
FILTER CLOGGED)

METHOD FOR COMPACTING LOW DENSITY ARTICLES

This application is a division of our co-pending application Ser. No. 843,119 filed Mar. 24, 1986, U.S. Pat. No. 4,669,375 for "Apparatus for Compacting Law Density Articles".

BACKGROUND OF THE INVENTION

This invention relates to methods for compacting low density articles such as used metal beverage cans to reduce their bulk. More specifically, it relates to a new and improved compacting method of this general character that is highly effective in operation and readily adaptable to accommodate articles of a wide range of densities.

In the interest of conservation of metal, it is customary to recycle used metal articles such as aluminum cans of the kind used for beverages. For convenience in handling and to facilitate the recycling process, it is desirable that the cans be compacted into units of substantially uniform size and weight. Apparatus has been proposed heretofore for this purpose, in which one or more charges of used containers supplied by a conveyor to a hopper are weighed and delivered to a chamber, in which they are compacted into a biscuit of given weight and size by a reciprocating ram, the compacted biscuit being discharged from the compactor by a second ram.

In one form of such apparatus, the hopper is mounted at one end of a beam balance and cans are supplied thereto until balance is achieved with a slidable weight on the other end that is set at a selected value. Since even cans of like construction and material are unlikely to be of uniform density because of variations in their condition after use (e.g., crushed or flattened), it is difficult to set the weight on the arm to a value such that overfilling of the hopper with spillage of cans and possible jamming of the machine will not occur. Accordingly, operators tend to set the weight at a low value so as to insure that this will not occur, even though this results in a substantial reduction in production capacity. Moreover, such apparatus cannot function to compress effectively materials whose density is less than about 1½ pounds per cubic foot, e.g., materials such as aluminum foil, bottle caps, pie pans and scrap.

It is an object of this invention, accordingly, to provide a new and improved compacting method of this character which is free from the above-noted deficiencies of the prior art.

A further object of the invention is to provide a novel compacting method of the above character enabling low density articles to be compacted into denser units of uniform size and weight more rapidly and effectively than has been possible heretofore.

Another object of the invention is to provide a new and improved method of the above character that is capable of compacting articles of a wide range of densities continuously and automatically in a highly effective manner.

SUMMARY OF THE INVENTION

According to the invention, conveyor means is provided for supplying low density articles such as aluminum beverage cans to a hopper, from which they are adapted to be dumped into a compression chamber and compressed into a unit product by a first reciprocable platen powered by a hydraulic ram. The compacted unit or biscuit is adapted to be discharged through an openable door by a second hydraulically powered reciprocable platen desirably disposed to move at an angle to the movement of the first platen.

The hopper is mounted at one end of a beam balance for determining the weight of the charge contained therein and, while being filled, is located to one side of the compression chamber near the top thereof. The hydraulic ram for the first platen and the hopper are directly linked so that when the former is at its retracted position it can be swung laterally by operation of a hydraulic actuator to position the hopper over the top of the compression chamber for discharge of its contents into the latter.

In the practice of the method, articles to be compressed are supplied to the hopper only until a predetermined level is reached as determined by sensor means. The charge in the hopper is then weighed before being dumped into the compression chamber. If more than one charge is required to produce a biscuit of given weight, the weights of successive charges are totalized until the desired biscuit weight has been reached.

The weight of a charge of articles in the hopper is measured in terms of the displacement of the end of the beam balance away from the hopper caused by the charge in the hopper. In a preferred embodiment, a selected weight for the biscuit is represented by presetting the positional separation between a member and a sensor, and successive displacements of the beam balance end are caused to reduce the separation incrementally until the member is in position to actuate the sensor to indicate that the selected biscuit weight has been reached.

Operation of the conveyor means to fill the hopper, the weighing and dumping of the hopper contents into the compression chamber, the extension and retraction of a platen therein by the first hydraulic ram, the opening of an exit door from the compression chamber, and the extension and retraction of a second hydraulic ram-actuated platen to discharge a compacted biscuit from the chamber are controlled automatically by a programmed computer. Also, a constant torque-variable displacement pump is used in the hydraulic system and the hydraulic rams are moved very rapidly, means being provided to slow them down before the end of each stroke so as to avoid possible damage. As a result, the invention enables greater speeds of operation than have previously been possible.

DETAILED DESCRIPTION OF THE EMBODIMENTS

For a better understanding of the invention, reference is made to the following detailed description, taken in conjunction with the accompanying drawings, in which:

FIG. 3B illustrates schematically a constant torque-variable speed pump suitable for use in the hydraulic control system shown in FIG. 3A.

FIG. 6 illustrates schematically novel position sensing means for determining when the hydraulic actuators employed in the apparatus of FIG. 1 are located at predetermined positions;

FIGS. 7 and 8 illustrate schematically different forms of components for use with the position sensing means shown in FIG. 6;

FIGS. 12A and 12B, positioned side-by-side, form an input/output schematic diagram of a typical programmable controller for effecting the operations outlined in FIGS. 9, 10 and 11.

DESCRIPTION OF A PREFERRED EMBODIMENT

Figure 1:
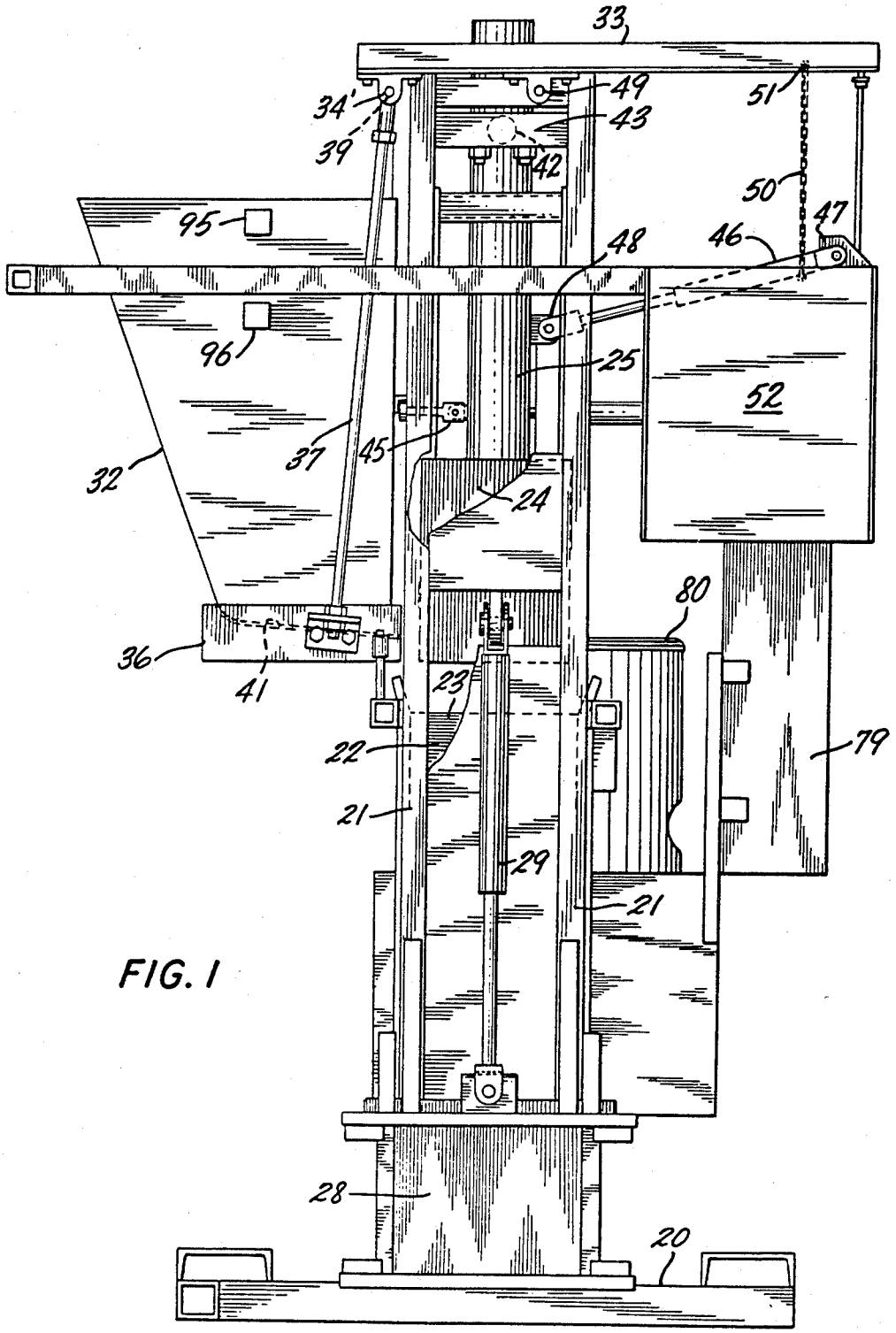
FIG. 1 is a view in front elevation of compacting apparatus constructed according to the invention.
Figure 2:
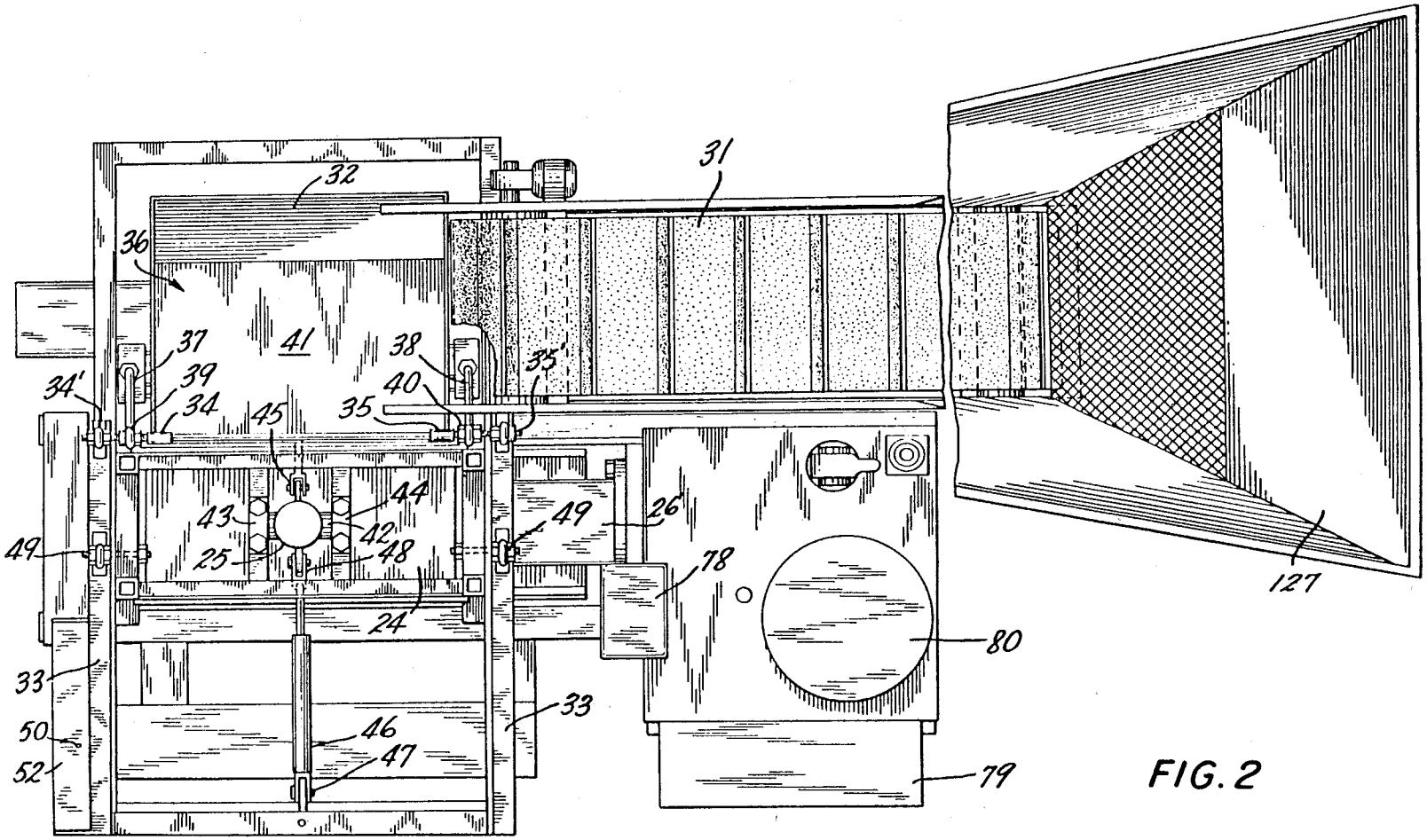
FIGS. 2 and 3 are top and right side views, respectively, of the apparatus shown in FIG. 1.
Figure 3:
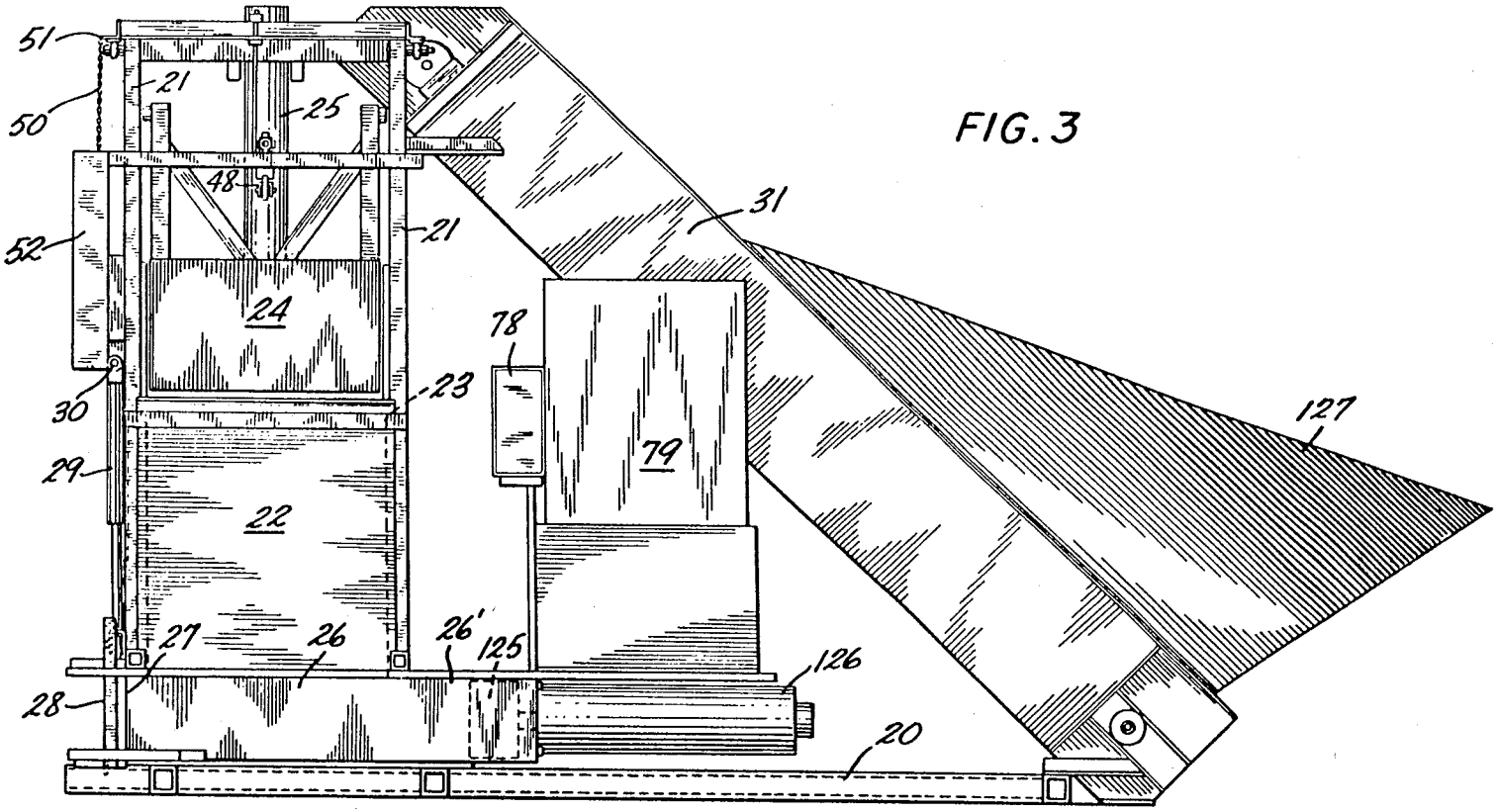

Referring first to FIGS. 1 through 3, compacting apparatus is shown comprising a base 20 supporting a frame 21 carrying a vertical cylinder 22 open at the top 23, in which a platen 24 is adapted to be reciprocated by a hydraulic cylinder 25 to compress articles fed into the cylinder 22 through the opening 23. The cylinder 22 terminates at its bottom in a compression chamber 26 having a door opening 27 at the front end of the machine through which a compacted biscuit is adapted to be discharged.

The opening 27 is normally closed by a door 28 which is adapted to be opened at the appropriate time in the operating cycle by actuation of a hydraulic cylinder 29 having one end 30 secured to the frame of the machine. The chamber 26 has an extension 26' to the rear of the machine in which a main platen 125 is adapted to be reciprocated by a main hydraulic cylinder 126 mounted on the machine frame.

Articles for compaction such as used aluminum cans, for example, are supplied from a bin 127 by a conveyor 31 to a hopper 32 located at the top of the machine. As best shown in FIGS. 1 and 2, the hopper 32 is pivotally mounted at 34 and 35 on a shaft supported in bearings 34' and 35' at one end of a beam balance 33. The hopper 32 is open at the bottom and is normally positioned at one side of the machine as shown in FIG. 1. While in that position, the bottom is closed off by a base 36 supported by rods 37 and 38 pivoted at 39 and 40 concentrically with the pivots 34 and 35 for the hopper 32.

The base 36 has a bottom 41 which is slightly curved downwardly towards the machine, as shown in dotted lines in FIG. 1, and the bottom edge of the hopper 32 is similarly shaped but slightly spaced therefrom so that the hopper 32 can be swung in the direction of the machine relatively to the base 36 in order to dump a charge of articles contained therein into the cylinder 22 of the machine, as described in greater detail below.

The vertical cylinder 25 for the platen 24 is mounted on a shaft 42 supported in bearings 43 and 44. Also, the cylinder 25 is directly coupled to the hopper 32 by a rigid link 45, and a hydraulic cylinder 46 attached to the frame at 47 is connected to the cylinder 25 at 48 for moving the cylinder 25 and the hopper 32 as a unit to bring the latter over the top 23 of the cylinder 22 at the proper time in the operating cycle, as described in greater detail hereinafter.

The weigh beam balance 33 is pivoted at a fulcrum 49 such that the distance from the hopper pivot points 34 and 35 to the fulcrum 49 is, say, one-half the distance from the latter to the other end of the beam 33.

Figure 4:
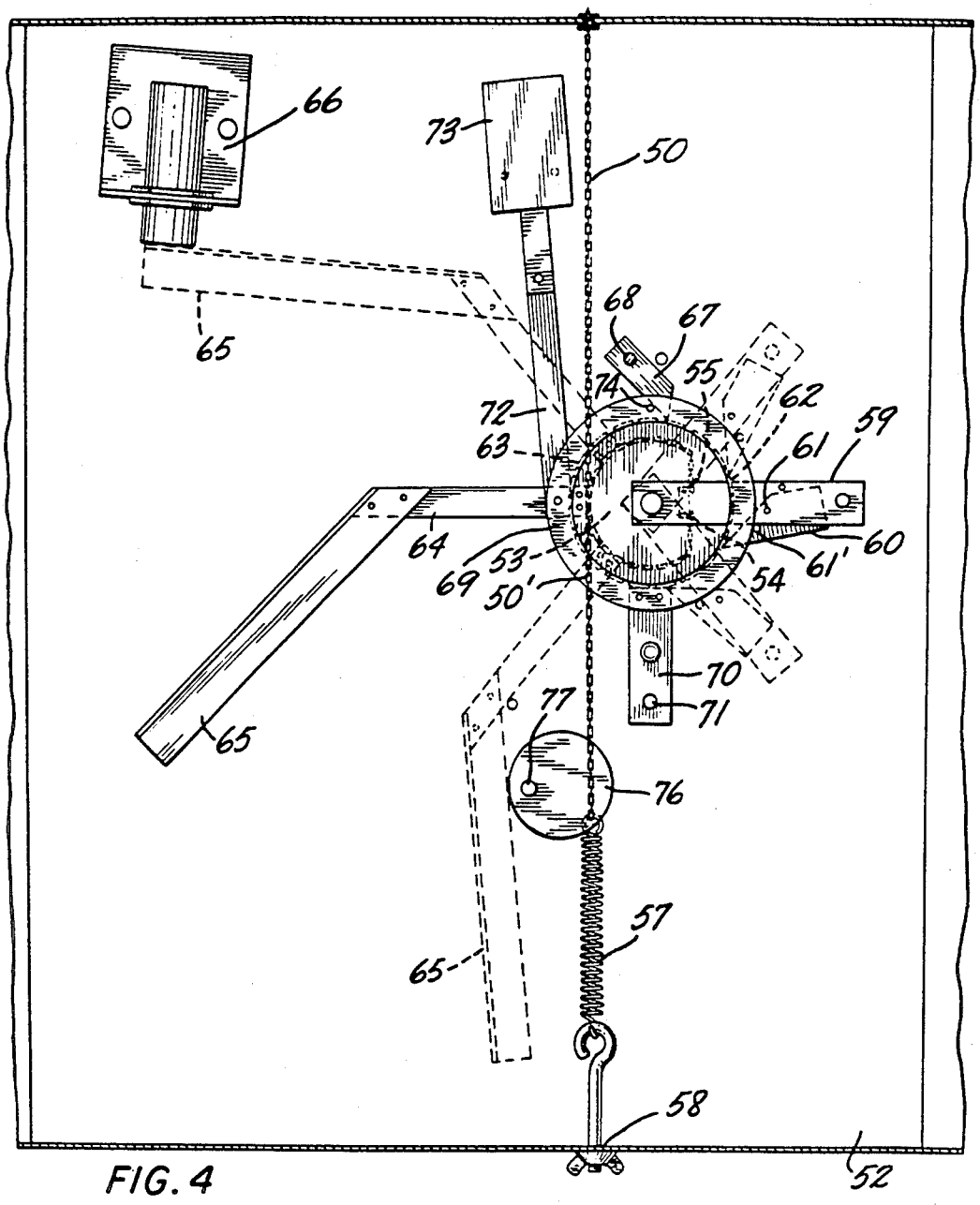
FIG. 4 is a front view of one form of weight totalizer apparatus for use with the apparatus shown in FIG. 1.
Figure 5:
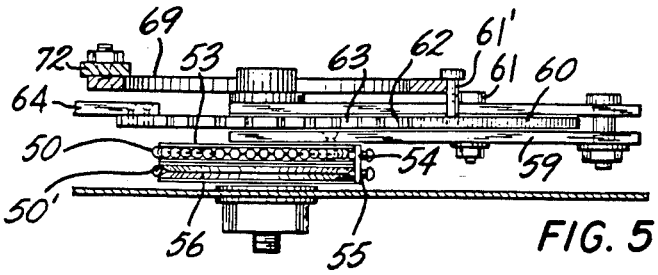
FIG. 5 is a partial bottom view of the weight totalizer apparatus shown in FIG. 4.

A small diameter ball chain 50 is connected at a point 51 on the beam 33 and transmits the motion of the end of the beam 33 as the hopper is being loaded to weight measuring and totalizing apparatus contained in a housing 52 and shown in greater detail in FIGS. 4 and 5. As shown in FIG. 4, the lower end of the chain 50 is wrapped around a pulley 53 and anchored therein at the point 54 (FIG. 5). A second section of chain 50' anchored at the point 55 passes over a second pulley 56 fixed to the pulley 53 and is connected to the upper end of a spring 57, the lower end of which is secured to the frame of the machine at 58. The spring 57 counterbalances the weight of the empty hopper 32 and establishes a reference for measuring the weight of a charge of articles contained therein. An arm 59 secured to the pulley 53 for rotation therewith carries a pawl 60 pivoted at 61 and spring-biased into engagement with teeth 62 formed on the outer periphery of a wheel 63, to which is secured an arm 64.

The chain 50 is wrapped around the pulley 53 in such fashion that as the end of the beam balance 33 moves upwardly during the filling of the hopper 32, the wheel 63 is rotated in the clockwise direction by the action of the pawl 60 engaging the teeth 62. Movement of the wheel 63 also rotates the arm 64 in the clockwise direction and moves the outer end thereof 65 towards a proximity switch 66, which may be, for example, a conventional capacitance proximity switch. A second pawl 67 pivoted at a point 68 is spring-urged into engagement with the teeth 62 on the wheel 63 to prevent the latter from rotating in the counterclockwise direction until released as described below.

The pawls 60 and 67 are adapted to be released at the proper time in the operating cycle by an annular member 69 secured to an arm 70 pivoted at the point 71 and connected to an arm 72 for actuation by a solenoid 73. When the solenoid 73 is energized as described below, the annular member 69 is moved in the clockwise direction, causing a stop 74 thereon to move the pawl 67 away from the wheel 63. At the same time it acts against a stop 61' on the pawl 60 to move the latter away from the wheel 63. With the pawls 60 and 67 disengaged from the teeth 62, the spring 57 causes the pulleys 53 and 56 and the arm 64 to rotate in the counterclockwise direction to an initial position to be ready for another weight measurement.

Figure 12B:
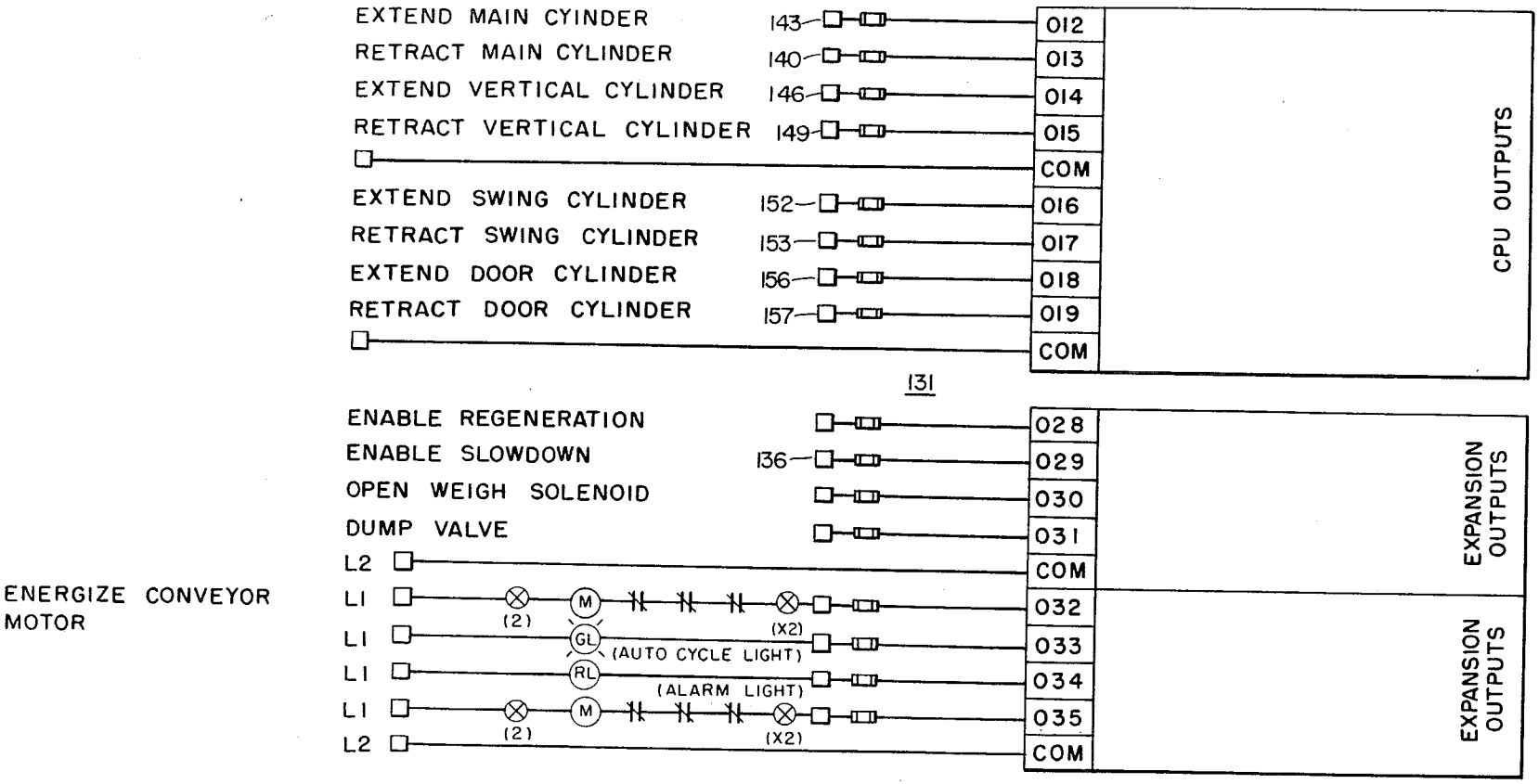

The initial position for the end 65 of the arm 64 may be set for different biscuit weights by adjustment of an eccentric wheel 76 pivoted at 77 and positioned to form a stop against which the arm end 65 will come to rest after movement in the counterclockwise direction. Achievement of the desired batch weight for which the end 65 of the arm 64 has been set occurs when the arm end 65 arrives at the proximity switch 66. This causes the latter to transmit a signal to the input terminals 130 of a programmed computer 131 (FIGS. 12A and 12B) mounted on a control panel 79 (FIG. 3).

Figure 3A:
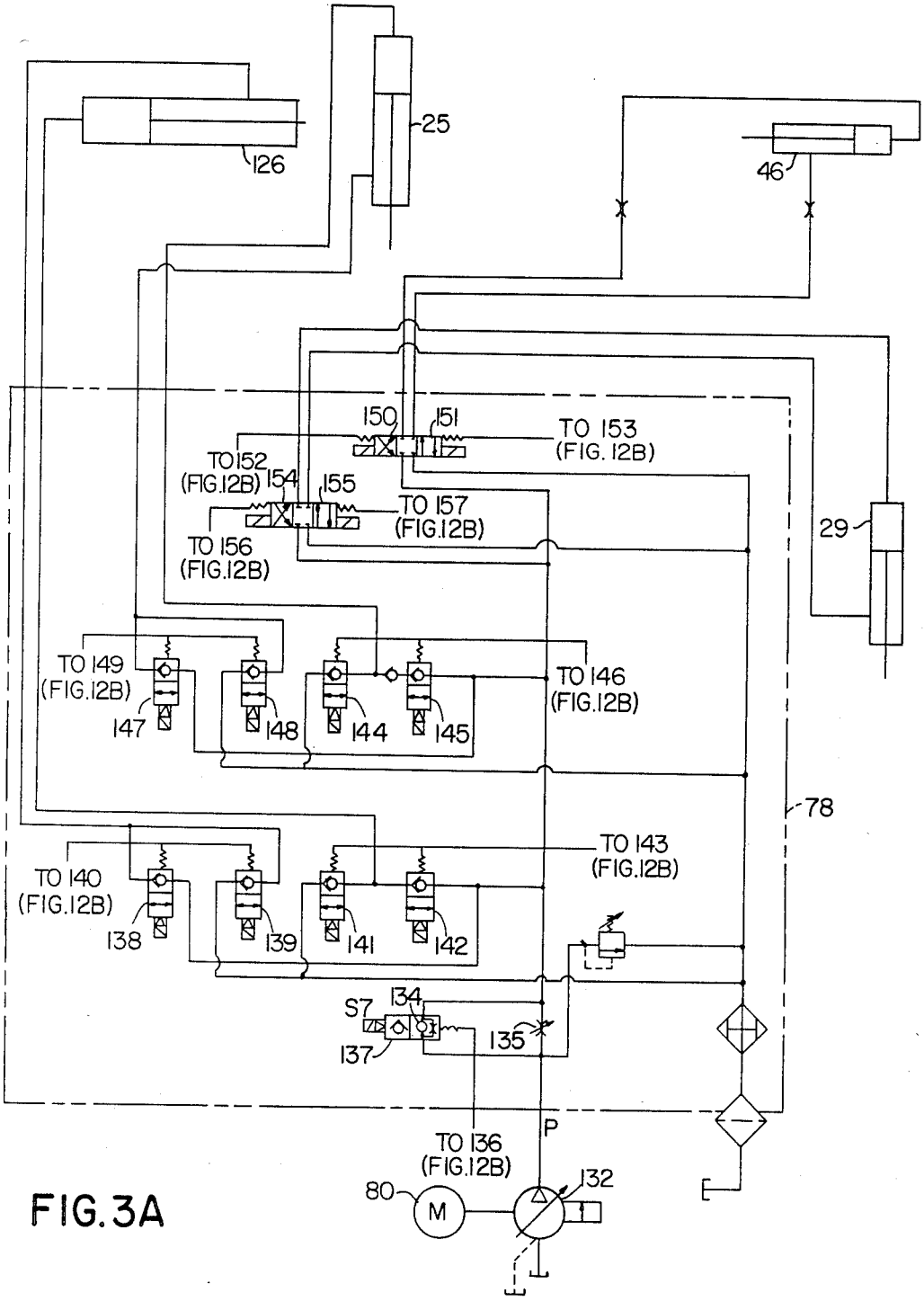
FIG. 3A illustrates schematically a hydraulic control system for use in the compacting apparatus shown in FIGS. 1–3.

The cylinders 25, 126, 29 and 46 are all supplied with hydraulic fluid from a conventional hydraulic controller 78 (FIGS. 2 and 3A) responsive to control signals from the programmed computer 131. The hydraulic controller 78 is supplied with hydraulic fluid from a constant torque-variable displacement pump 132 driven by a motor 80. The hydraulic controller 78 is of the conventional type, having large and small orifices 134 and 135, respectively, supplying hydraulic fluid to each cylinder. During the initial part of the stroke, the hydraulic cylinders are fed with hydraulic fluid from both of the two orifices, so that they move very rapidly. In order to avoid the possibility of damage, a timer in the computer 131 measures the travel time of each cylinder, and shortly before the end of each stroke causes the computer to transmit a signal from the terminals 136 (FIG. 12B) to a valve 137 which closes the large orifice 134, thereby restricting the flow of the hydraulic fluid to the smaller orifice 135 to slow down the piston before it reaches the end of its stroke.

Control of the supply of hydraulic fluid to the respective cylinders is effected by a plurality of control valves that are actuated at the proper times in response to control signals transmitted from the computer 131.

Thus, the supply and return of hydraulic fluid for retracting the main cylinder 126 is controlled by the solenoid valves 138 and 139 (FIG. 3A) which are adapted to be actuated by signals transmitted from the terminal 140 of the computer 131. The supply and return of hydraulic fluid to extend the main cylinder 126 is controlled by the solenoid valves 141 and 142 which are adapted to be actuated by signals transmitted from the terminal 143 (FIG. 12B) of the computer 131.

The supply and return of hydraulic fluid for the vertical cylinder 25 to extend the same is controlled by the solenoid valves 144 and 145 in response to signals transmitted from the computer terminal 146, and retraction of the cylinder 25 is controlled by the hydraulic valves 147 and 148 in response to signals from the computer terminal 149.

Control of the swing cylinder 46 is effected by solenoid valves 150 and 151 in response to signals transmitted from the computer terminals 152 and 153, respectively. Also, the door opening cylinder 29 is controlled by solenoid valves 154 and 155 in response to signals transmitted from the computer terminals 156 and 157, respectively.

Since most of the machine operation is at low hydraulic pressure, it is possible to use an oversized constant torque-variable displacement pump with a relatively small motor. The pump 132 may be of a conventional, wellknown type, comprising multiple pistons 176 and 177 (FIG. 3B) adapted to be stroked by a cam 178 movable angularly with respect to the shaft 179 in response to torque to change the pump stroke. To this end, the cam 178 may be moved by hydraulic means 180 in response to the hydraulic pressure in the hydraulic controller 78.

All of the hydraulic cylinders are provided with sensors for providing indications of fixed ram or platen positions to input terminals of the computer 131 (FIG. 12A) in the control panel 79 for control purposes. Sensors of the kind shown in FIGS. 6–8, inclusive, are of particular utility for this purpose. Since they are mounted on the cylinders in essentially the same way, it will be necessary to describe only one in detail.

As shown in FIG. 6, for example, arrival of the platen 24 at predetermined fixed locations may be sensed by securing to it a member 81 slidable in a tube 82 fastened to the platen cylinder 25 by links 83. Formed at predetermined locations in the fixed tube 82 are a plurality of openings 84, 85, near which proximity switches 88, 89 of the capacity type are positioned. Cooperating grooves 86 and 87 are formed at spaced apart locations in the member 81, as shown in FIG. 7, such that when the grooves 86 and 87 in the member 81 are in alignment with the respective openings 84 and 85 in the tube 82, the proximity switches 88 and 89 will be actuated to indicate that the platen 24 is at one or the other of predetermined fixed positions.

Thus, the groove 87 might be positioned in relation to the opening 85 such that when the cylinder 25 is in the retracted position, the proximity switch 89 transmits a signal indicative of that fact to the input terminals 158 and 159 of the computer 131 (FIG. 12A). Similarly, the groove 86 in the member 81 might be positioned in relation to the opening 84 such that when the cylinder 25 is in the extended position, the proximity switch 88 transmits a signal indicative of that fact to the computer input terminals 160 and 161 (FIG. 12A).

Similar sensors may be provided on the main cylinder 126, the swing cylinder 46 and the door cylinder 29 to transmit to the computer input terminals 162 and 163, 164 and 165, 166 and 177, respectively, signals indicating that the respective cylinders are in the retracted positions, and to supply to the computer terminals 170 and 171, 172 and 173, 174 and 175, respectively, signals indicating that the respective cylinders are in the extended positions.

A tubular member 90 may be used in place of the solid member 81, as shown in FIG. 8, suitable openings 91 and 92 being formed therein at positions selected so that the desired signals will be produced when the platen 24 reaches the predetermined spatial positions.

OPERATION

Figure 10:
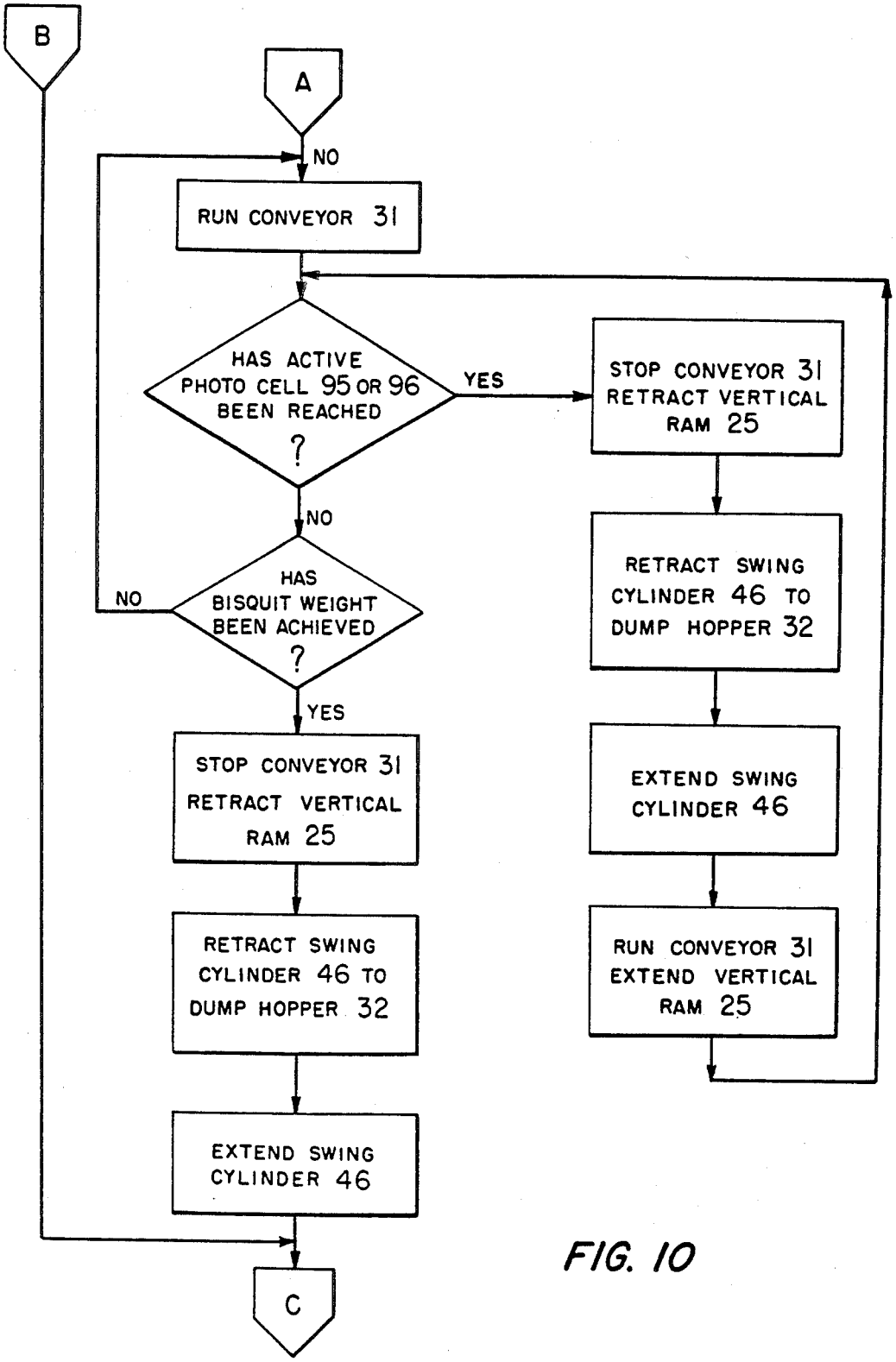
Figure 11:
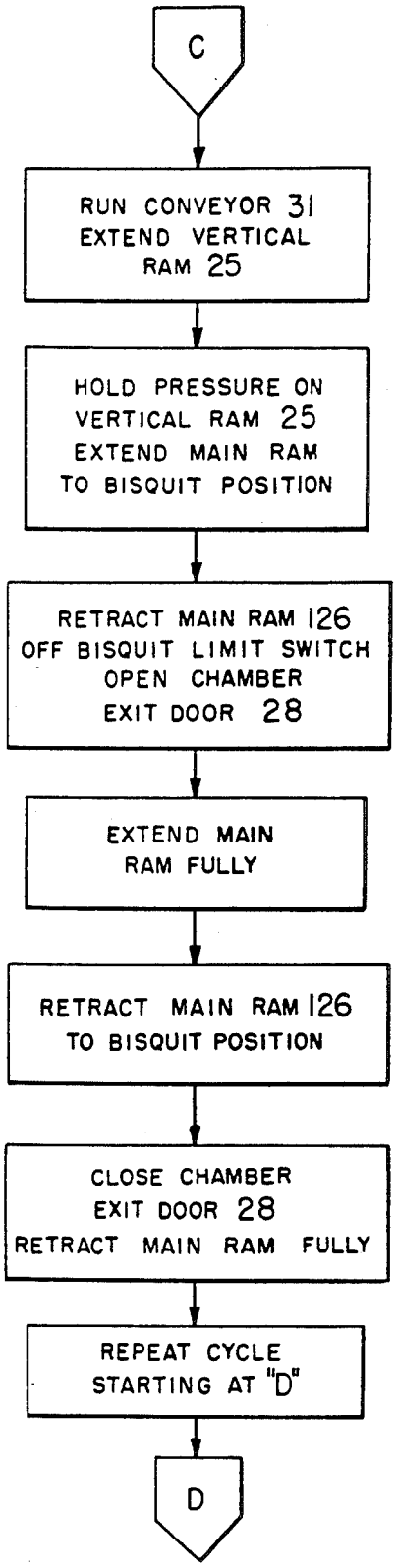

As stated, operation of the compacting machine is controlled by a programmed computer which receives input from the various sensors and provides outputs for controlling the several elements to produce biscuits of uniform size and weight from used aluminum cans fed to the hopper 32. A typical operating cycle will be described herein in connection with FIGS. 9, 10 and 11, which constitute a flow diagram for the operating program, and FIGS. 12A and 12B which illustrate schematically the inputs and outputs to the programmable controller 78 in the control panel 79.

Figure 9:
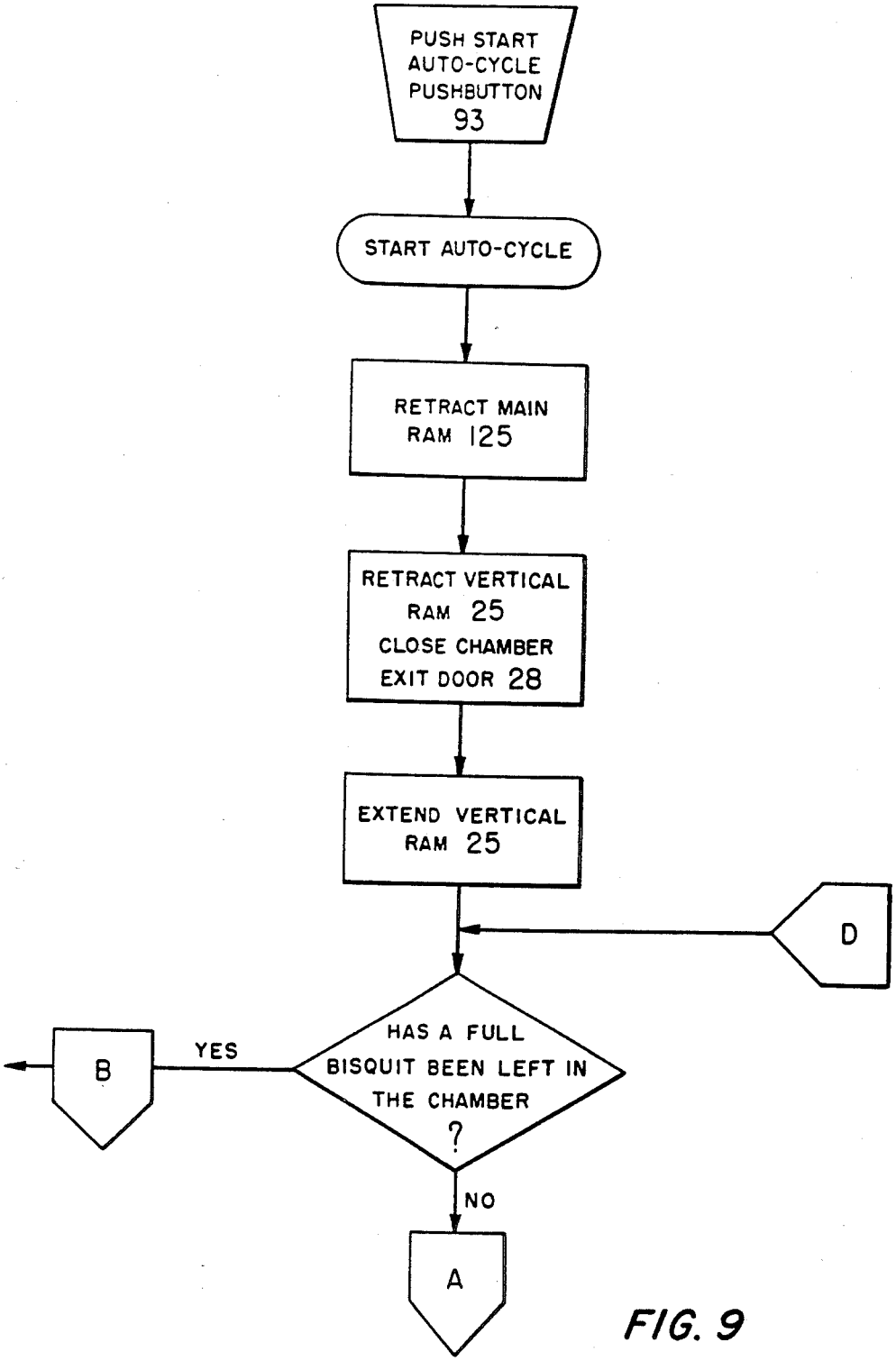
FIGS. 9, 10 and 11 illustrate a flow diagram of a typical computer program for automatic operation of the compactor apparatus of FIG. 1.

Operation is initiated by pushing the automatic cycle start button 93 and the pump start button 94 on the control panel 79 (FIG. 12). As indicated in FIG. 9, the position of the main ram 29 is now sensed and, if extended, it is retracted. Also, the vertical ram 25, if extended, is retracted and the chamber exit door 28 is closed. The vertical ram 25 is then extended and the possible presence of a full biscuit in the chamber 26 is sensed.

If no biscuit is present in the chamber 26, the conveyor 31 is run (FIG. 10) to supply used cans from the bin 127 to the weigh hopper 32. The hopper 32 is provided with a photosensitive detector 95 near the top thereof (FIG. 1) which is adapted to transmit a signal to the input terminals 181 and 182 (FIG. 12A) of the computer 131 to indicate when the hopper is full. Until the level of cans in the hopper 32 has reached the level of the photocell, the conveyor 31 continues to run. When that level has been reached, the conveyor 31 is stopped and the vertical ram 25 is retracted. The swing cylinder 46 is now actuated to dump the contents of the hopper 32 into the top of the cylinder 22. The swing cylinder 46 is then extended to restore the hopper 32 to its initial position, the conveyor 31 is run, and the vertical ram 25 is extended to compress the charge of containers in the compression chamber 26 at the bottom of the machine.

The hopper 32 is also provided with a second photosensitive device 96 (FIG. 1) positioned to transmit a signal to the input terminals 183 and 184 of the computer 131 when the containers being supplied from the conveyor 31 fill the hopper 32 to a lower level, say, about three-fourths its height. When the three-fourths level has been reached by the cans, the conveyor 31 is again stopped, the vertical ram 25 retracted, and the swing cylinder 46 retracted to dump the contents of the hopper 32 into the compression chamber 26. The swing cylinder 46 is again extended, the conveyor 31 is run to continue supplying cans to the hopper 32, and the vertical ram is extended to compress the second charge fed into the compression chamber 26.

The computer continuously senses the condition of the photocells 95 and 96, and if the level of the appropriate one has not been reached by the cans being supplied, it senses to determine whether the desired biscuit weight has been achieved by the cans previously compressed in the compression chamber. If not, the conveyor is run to continue feeding unused cans to the hopper 32.

When the desired biscuit weight has been achieved as determined by the weighing mechanism, the conveyor 31 is stopped and the vertical ram 25 is retracted. The swing cylinder 46 is then retracted to dump the contents of the hopper 32 into the compression chamber and then is extended to bring the hopper 32 to its initial position.

The conveyor 31 is run again, and the vertical ram 25 is extended and pressure is held on it in the extended position; the main ram 126 is extended to the biscuit position and then retracted to a position approximately one inch off the biscuit position. The chamber exit door 28 is then opened and the main ram 126 fully extended to discharge the formed biscuit through the door 27. The main ram is retracted to the biscuit position, the exit chamber door 28 is then closed and the main ram 126 fully retracted. The program then goes to D (FIG. 12) to begin the formation of another biscuit.

In the event that at the start of an operating cycle the computer senses the presence of a full biscuit that has been left in the compression chamber 26 (FIG. 9), the program jumps to C (FIG. 11) and executes the various operations required to compress the biscuit and discharge it from the machine, as described above.

In typical operations, a compacted biscuit can be made with apparatus according to the invention in about 38 seconds, and 25 lb. biscuits can easily be produced at a rate of about 2,300 lbs./hour, with a biscuit weight accuracy within about one pound.

The invention thus enables low density articles such as used aluminum cans to be compressed into biscuits of uniform size and weight effectively and at a high production rate. By operating the rams at high speed and slowing them down only at the end of the stroke, the operation of the machine can be substantially speeded up. Moreover, by accurately measuring the weight of the articles fed to the hopper, the machine can be operated at maximum capacity and is readily adaptable for use with articles of very low density, such as foil, bottle caps, pie plates, and the like.

The specific embodiments described above are intended to be only illustrative, and modifications in form and detail are possible within the scope of the following claims.

We claim:

1. A method of compacting low density articles of varying densities comprising the steps of providing a compression chamber having at its open upper end hopper means for containing articles to be compressed and first platen means for compressing said articles, said hopper means being movable into and out of article dumping relation to said compression chamber, and said platen means being movable into and out of compressing relation to said compression chamber, providing conveyor means for supplying said low density articles to the hopper means, actuating the conveyor means to feed said articles into the hopper means, introducing a quantity of said articles to be compressed into said hopper means while the latter is out of said container dumping relation, sensing the level of the articles fed into the hopper means and, in response to a predetermined sensed level, disabling the conveyor means, moving said hopper means into dumping relation with respect to said compression chamber while said platen means is out of compressing relation therewith and dumping the contents of said hopper means into said compression chamber, moving said hopper means out of dumping relation with said compression chamber and said platen means into compressing relation with respect to said compression chamber, and compressing the articles dumped into said compression chamber by extension of said platen means into the compressor chamber.

2. In a method as in claim 1, the steps of determining the weight of each charge or quantity of said articles dumped into the hopper means, selecting a predetermined weight for the compressed articles, continuing the article feeding, dumping and compressing steps until the total of the weights of a succession of charges equals the predetermined weight and a compressed biscuit of the predetermined weight is formed in the compression chamber, and discharging the compressed biscuit from the compression chamber.

3. A method as in claim 2 in which the hopper means is mounted at one end of a beam balance and the weight of its contents is determined by causing the displacement of the other end of the beam balance to alter the spatial relation between a sensor and an actuator until the sensor is actuated.

4. In a method as in claim 3, the steps of providing the compression chamber with an exit opening closed by an openable door and second platen means movable transversely of said compression chamber towards and away from said exit opening, advancing said second platen means to further compress a biscuit of predetermined weight when formed, while maintaining said biscuit under compression by said first platen means, opening said exit door, further advancing said second platen means to discharge said formed biscuit through said exit opening, and retracting said first and second platen means and closing said exit door.

5. In a method as in claims 1 or 4, the steps of operating said platen means at a rapid rate during an initial part of the extension thereof into said compressor chamber and at a slower rate during the latter part of the extension thereof.

* * * * *